US006949742B1

(12) United States Patent
Figueroa

(10) Patent No.: US 6,949,742 B1
(45) Date of Patent: Sep. 27, 2005

(54) METHOD AND A SYSTEM FOR PRODUCING ELECTROSPRAY IONS

(75) Inventor: Iddys D. Figueroa, Dorado, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 10/801,743

(22) Filed: Mar. 15, 2004

(51) Int. Cl.[7] ..... H01J 49/04; B41J 2/015; B41J 2/04

(52) U.S. Cl. ..... 250/288; 250/289; 347/1; 347/2; 347/15; 347/16; 347/20; 347/43; 347/48; 347/50; 347/66; 347/85; 347/86; 347/87; 347/100

(58) Field of Search ..... 250/288, 289; 347/1, 2, 15, 16, 20, 43, 48, 50, 66, 100, 347/85–87

(56) References Cited

U.S. PATENT DOCUMENTS 4,877,997 A * 10/1989 Fein ..... 313/634
4,965,484 A * 10/1990 Fein ..... 313/15
5,245,246 A * 9/1993 Boland et al. ..... 313/15
5,594,652 A * 1/1997 Penn et al. ..... 700/119
5,677,190 A * 10/1997 Melanson et al. ..... 436/146
5,760,393 A 6/1998 Vestal et al.
6,001,309 A * 12/1999 Gamble et al. ..... 422/100
6,513,897 B2 * 2/2003 Tokie ..... 347/15
6,541,765 B1 4/2003 Vestal
6,627,879 B2 9/2003 Reily et al.
6,649,907 B2 * 11/2003 Ebeling et al. ..... 250/288
6,663,214 B1 * 12/2003 Chen et al. ..... 347/20
2002/0085054 A1 * 7/2002 Tokie ..... 347/15
2002/0096631 A1 * 7/2002 Andrien et al. ..... 250/288
2003/0230823 A1 * 12/2003 Bartholomew ..... 264/156
2004/0206901 A1 * 10/2004 Chen et al. ..... 250/288
2005/0035285 A1 * 2/2005 Tan et al. ..... 250/288
2005/0054083 A1 * 3/2005 Vuong et al. ..... 435/287.2

* cited by examiner

*Primary Examiner*—John R. Lee
*Assistant Examiner*—Bernard E. Souw

(57) ABSTRACT

A system for producing electrospray ions includes a thermal inkjet material dispenser configured to selectively emit a plurality of sample material particles, and an electrically conducting grid disposed in proximity with the thermal inkjet material dispenser, the grid being configured to permit a selective passage of the emitted sample material particles.

70 Claims, 10 Drawing Sheets

METHOD AND A SYSTEM FOR PRODUCING ELECTROSPRAY IONS

BACKGROUND

Electrospray is a method of generating a very fine liquid aerosol through electrostatic charging. Electrospray, as the name implies, uses electricity in conjunction with or rather than gas to form small droplets. In electrospray, a plume of droplets is generated by electrically charging a liquid passing through a nozzle to a very high voltage. The charged liquid in the nozzle is forced to hold more and more charge until the liquid reaches a critical point at which it ruptures into a cloud of tiny, highly charged droplets.

When electrospray is used as a soft ionization method for chemical analysis, the more generally accepted term is "electrospray ionization" (ESI). Electrospray ionization is the process of generating a gas phase ion from a typically dissolved solid or liquid chemical species. This process is referred to as "soft" ionization since the molecule being ionized does not fall apart or break-up during the process.

The electrospray process has profoundly affected the field of mass spectrometry by allowing structural analysis of unlimited molecular weight, e.g., large biomolecules, and being directly compatible with liquid chromatography methods. Ionization is an important event in mass spectrometry by allowing accurate mass to charge ratio measurements of ions. A mass spectrometer is an instrument which can measure the masses and relative concentrations of atoms and molecules by evaluating a number of forces on a moving charged particle. Once an ion's mass is ascertained, this information can be used to determine its chemical composition.

While traditional electron spray ion sources have been used in the mass spectrometry of many molecules, larger than desired droplets are often generated resulting in adduct ion formation, or the bonding of molecules. Additionally, large droplets are not easily ionized, resulting in low sensitivity and signal. Moreover, many traditional electrospray ion sources are limited to producing a continuous flow of sample onto the mass spectrometer rather than a pulsed flow sample which may then be used in a time-of-flight type mass analyzer.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A number of exemplary methods and an apparatuses for using a modified thermal inkjet (TIJ) material dispenser as an electrospray ion source are described herein. More specifically, an exemplary method is described for generating a pulsed pack of electrospray ions with a modified thermal inkjet material dispenser. An electrically conducting grid is placed adjacent to the thermal inkjet material dispenser and allowed to produce an ion accelerating potential. This electrospray ion source allows for a linear instrument configuration when using a time-of-flight mass spectrometer. A linear instrument configuration results in a higher ion transmission to the mass spectrometer, leading to decreased detection limits and higher sensitivity. Additionally, the need to synchronize the orthogonal extraction with the source and the time-of-flight mass spectrometer is eliminated. A detailed explanation of the components and function of the present electrospray ion source will be given hereafter.

As used in this specification and in the appended claims, the term "thermal inkjet" or "TIJ" is meant to be understood broadly as any inkjet material dispenser that utilizes thermal energy to eject a jettable fluid. Additionally, the term "jettable fluid" is meant to be understood as a fluid that has suitable properties such as viscosity for precise ejection from an inkjet printing device. Moreover, the term "ion" is meant to refer to an atom or molecule which has a net negative or positive electrical charge. Typically in the electrospray process, the ion is formed by proton attachment or detachment. The term "potential" is meant to be understood both here and in the appended claims as referring to a difference in an electrical charge, expressed in volts, between two points in a circuit.

In the following description, for purposes of explanation, numerous specific details are set forth in order to provide a thorough understanding of the present system and method for using a modified thermal inkjet material dispenser as an electrospray ion source. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1A:
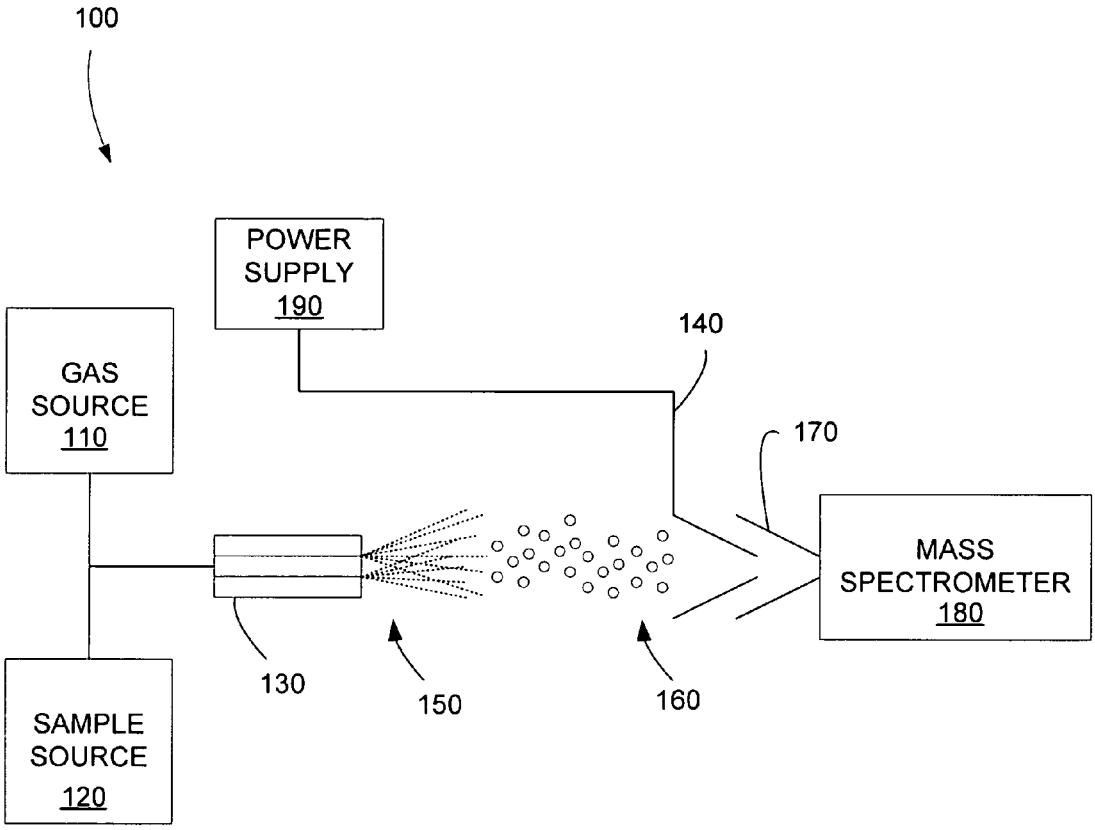
FIG. 1A Prior Art
FIG. 1A and FIG. 1B are simple block diagrams illustrating traditional electrospray configurations according to the prior art.

FIG. 1A illustrates a traditional electrospray configuration according to the prior art. As illustrated in FIG. 1A, a traditional electrospray ion source (100) configuration includes a gas source (110) such as compressed nitrogen (N2) and a sample material source (120) being fed directly to a plurality of platinum concentric needles (130). The gas source (110) forces a constant quantity per unit time of the sample material through the platinum concentric needles (130) producing a continuous flow of sample spray (150). A potential is then generated on a counter electrode (140) by a power supply (190) causing a continuous flow of electrospray ions (160) to be directed to a number of Einzel/ion lenses (170) and subsequently to a mass spectrometer (180).

In the linear arrangement illustrated in FIG. 1A, a continuous flow of sample may be produced. A number of mass analyzers such as quadrupole mass analyzers are well equipped to handle a continuous flow of sample. However, quadrupole mass analyzers have a mass to charge ratio cutoff of about 4,000 Daltons (Da). Time-of-flight mass spectrometers, in contrast to quadrupole mass analyzers, have (in theory) an unlimited mass to charge range. Consequently, it is often desirable to use a time-of-flight mass spectrometer. However, electrospray ionization time-of-flight mass spectrometers call for a pulsed sample of electrospray ions (160). Moreover, the spraying process illustrated by the traditional methods produces sample droplets that are larger than desired which often collided resulting in ion fragmentation. The larger than desired sample droplets are also more likely to have poor dissolvation often resulting in adduct ion formation caused by the bonding of molecules.

Figure 1B:
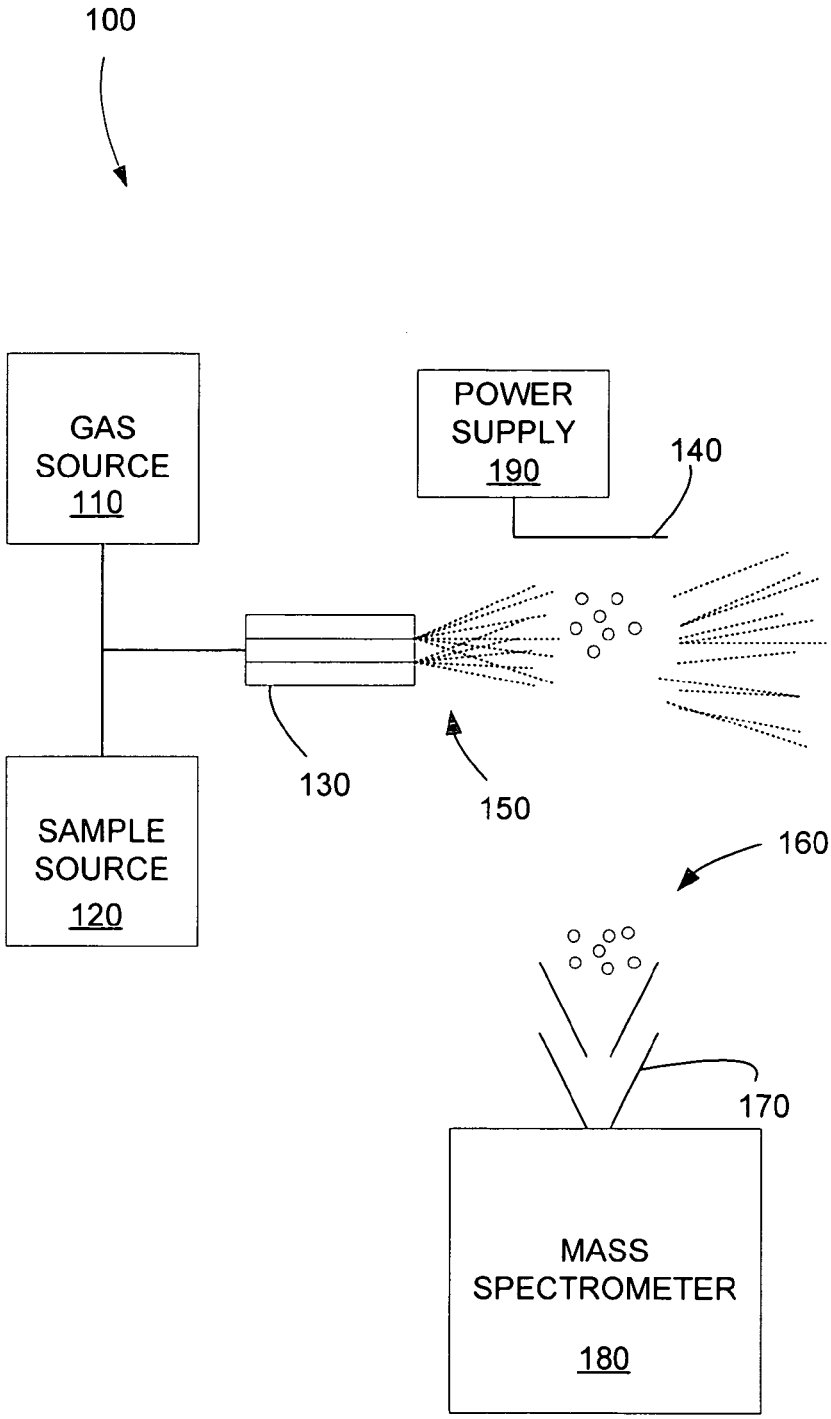
FIG. 1B Prior Art

FIG. 1B illustrates a traditional electrospray ion source (100) configuration for generating a pulsed ion source for an electrospray ionization time-of-flight mass spectrometer according to traditional methods. As illustrated in FIG. 1B, in order to produce a pulsed ion source, the platinum concentric needles (130) illustrated in FIG. 1A have an orthogonal orientation with respect to the mass spectrometer (180). As illustrated in FIG. 1B, a counter electrode (140) externally pulsed by a power supply (190) acts upon the flow of sample spray (150) causing a pulsed flow of electrospray ions (160) to be directed towards the mass spectrometer (180) for testing. However, by orienting the platinum concentric needles (130) orthogonal to the mass spectrometer (180), few ions are transmitted into the ion source, thereby limiting the sensitivity and detection limits of the instrument. Additionally, much of the sample is lost in the spraying process.

Figure 2:
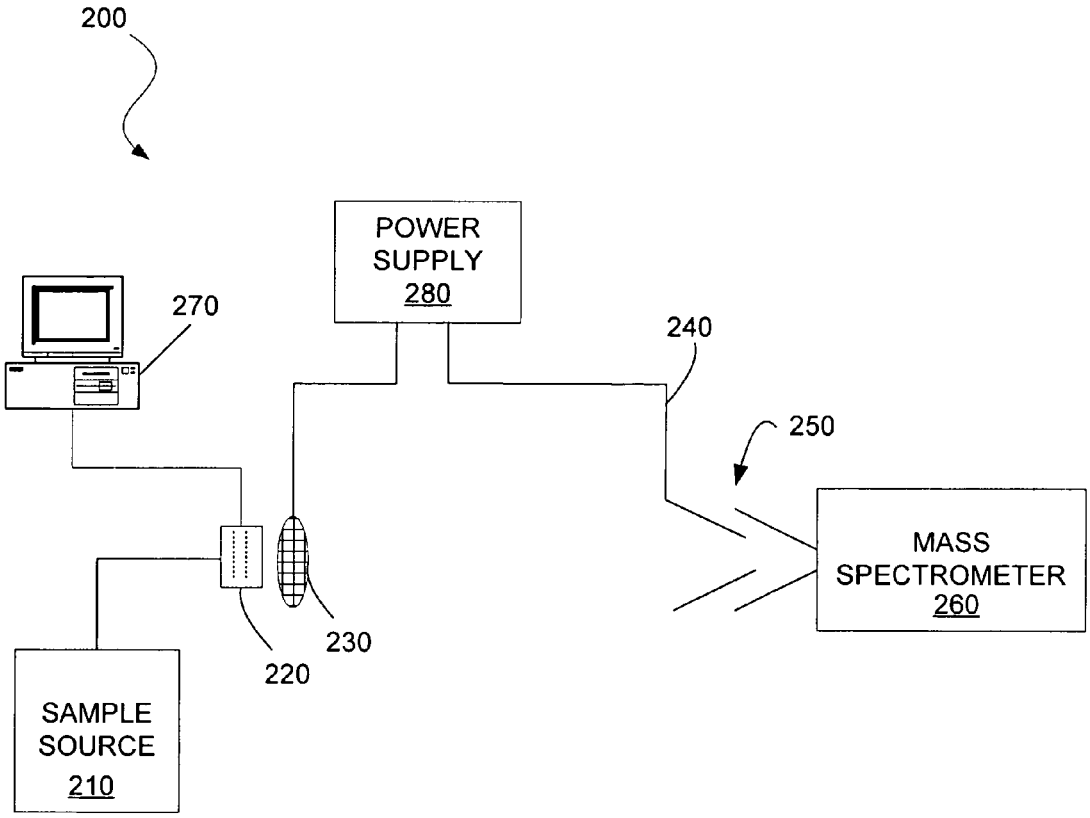
FIG. 2 is simple block diagram illustrating the components of an electrospray configuration including a thermal inkjet material dispenser according to one exemplary embodiment.

FIG. 2 illustrates the components of a thermal inkjet (TIJ) electrospray ion source (200) according to one exemplary embodiment. As illustrated in FIG. 2, the thermal inkjet electrospray ion source (200) includes a sample source (210) or sample reservoir fluidly coupled to a thermal inkjet material dispenser (220). Additionally, a computing device (270) may be communicatively coupled to the thermal inkjet material dispenser (220) according to one exemplary embodiment. An electrically conducting grid (230) is disposed adjacent to the thermal inkjet material dispenser (220) in the path of the nozzles of the thermal inkjet material dispenser. A counter electrode (240) coupled to a plurality of Einzel/ion lenses (250) that lead to a time-of-flight mass spectrometer (260) are disposed opposite the electrically conducting grid (230). Both the electrically conducting grid (230) and the counter electrode (240) are electrically coupled to a power supply (280) configured to independently vary the voltage at the electrically conducing grid and the counter electrode. As can be seen in FIG. 2, the present exemplary thermal inkjet electrospray ion source (200) allows for a linear configuration while providing a pulsed material sample to the mass spectrometer (260). The above-mentioned components of the exemplary thermal inkjet electrospray ion source (200) and their functions will now be explained in further detail below.

The thermal inkjet electrospray ion source (200) illustrated in FIG. 2 is configured to generate small droplets of a sample material using the thermal inkjet material dispenser (220). These generated droplets of sample material then react to a potential generated between the conducting grid (230) and the counter electrode (240). In response to the generated potential, the droplets of sample material are accelerated towards the Einzel/ion lenses (250) and the mass spectrometer (260). During this acceleration, an electrospray process occurs and the charged ions of the sample material are formed. In further detail, the electrospray process begins with an accumulation of positively charged ions in the small droplets of sample material, causing surface instability. When the Coulombic repulsions, or the repulsion among similarly-charged regions of a particle, between the positively charged ions exceed the surface tension of the sample material, smaller droplets will start to come off the surface of the liquid, forming a mist. As these droplets travel towards the counter electrode (240), a solvent portion of the sample material evaporates causing the droplets to shrink and, as a consequence, the distance between positive charges at the surface of the droplets become smaller and charge repulsion gets stronger. This process continues until the Coulombic repulsions are stronger than the surface tension of the droplet (a condition called the Rayleigh instability limit) causing the droplet to explode into smaller charged droplets of analyte molecules ready to be analyzed in the mass spectrometer (260). Further details of the electrospray process will be given below with reference to FIGS. 5 through 6C.

Figure 3A:
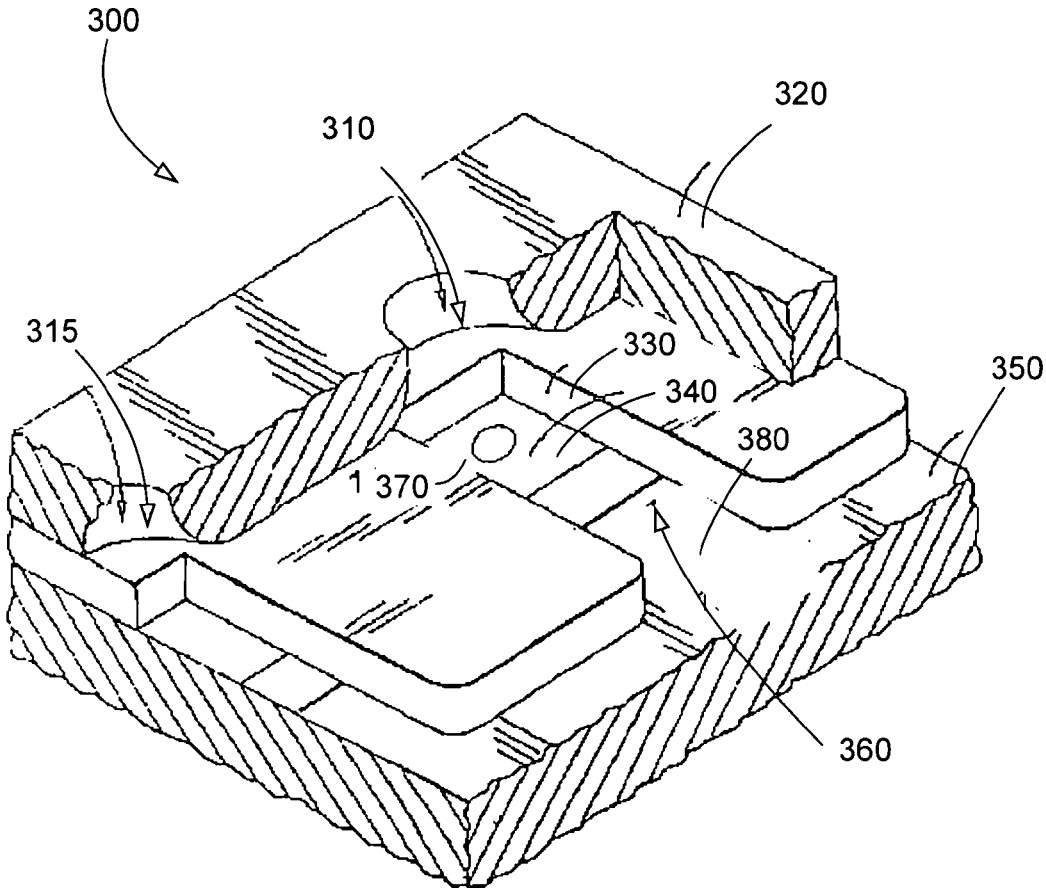
FIG. 3A is a sectioned isometric view of a thermal inkjet material dispenser according to one exemplary embodiment.

FIG. 3A illustrates a sectioned isometric view of a thermal inkjet material dispenser (300) that may be incorporated in a thermal inkjet electrospray ion source (200; FIG. 2) as illustrated in FIG. 2. As shown in FIG. 3A, a thermal inkjet material dispenser (300) configured to serve as an electrospray ion source may include a material firing chamber (360) and an orifice (310) associated with the material firing chamber (360). A portion of a second orifice (315) associated with another material firing chamber is also shown in FIG. 3A. The present system and method may include a thermal inkjet material dispenser (300) having either a single orifice or multiple orifices arranged in a predetermined pattern on an orifice plate (320). During operation, sample material, including an analyte and a solvent, may be supplied from the sample source (210; FIG. 2) to the firing chamber (360) through a chamber inlet (380) configured to replenish material which has been expelled from the orifice (310) as a result of material being vaporized by localized heating from a heating structure (340). The material firing chamber (360) is bounded by walls created by an orifice plate (320), a layered silicon substrate (350), and firing chamber barrel walls (370, 330). The size of the orifice (310) and the material firing chamber (360) may be varied to modify the size of the resulting material droplet. Additionally, the size of the resulting material droplet may be modified by varying firing frequencies and the material properties of the sample material.

Figure 3B:
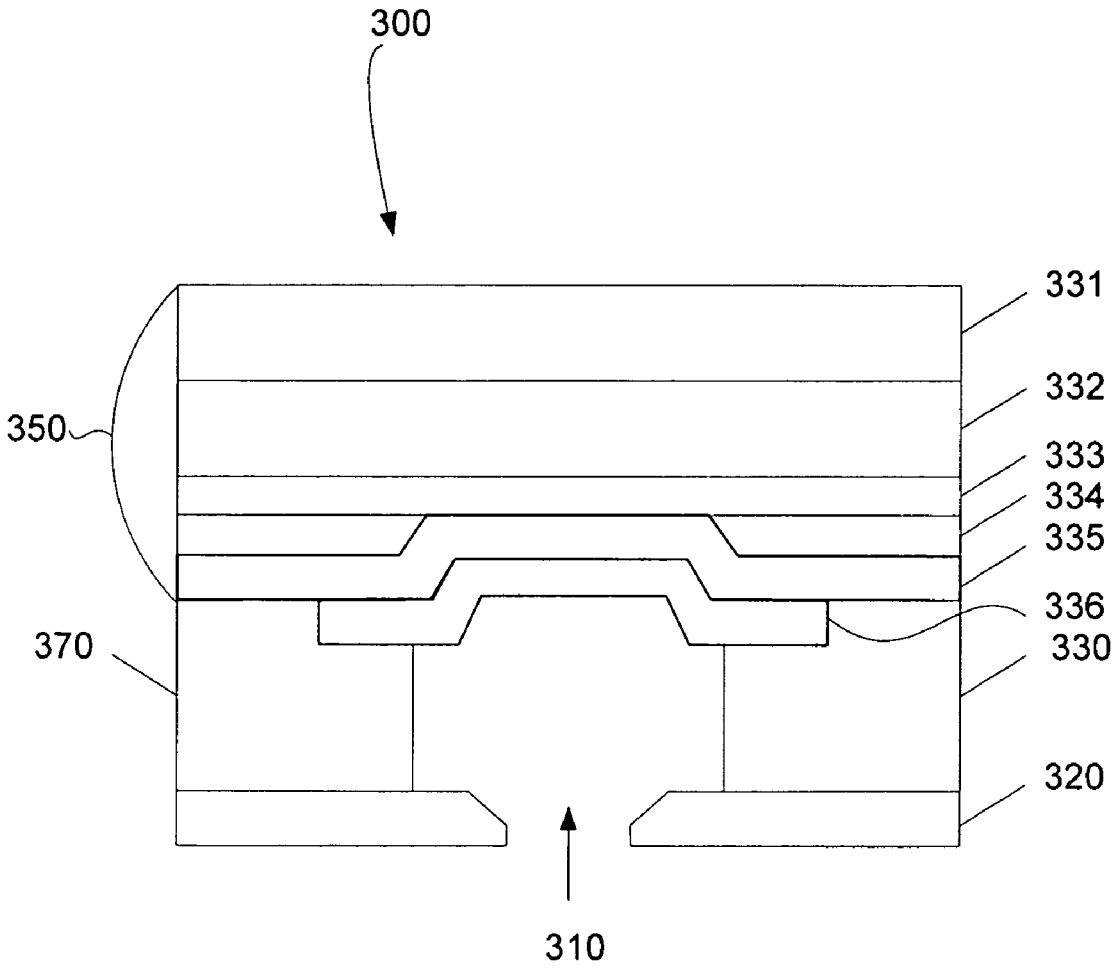
FIG. 3B is a cross-sectional view of a thermal inkjet material dispenser according to one exemplary embodiment.

FIG. 3B is a cross-section view of an exemplary inkjet firing chamber taken through the heating structure (340) to further illustrate the components of an exemplary thermal inkjet material dispenser (300). The silicon substrate (350) forming the base of the thermal inkjet material dispenser (300) has been expanded in FIG. 3B to enhance the features of its construction. It is assumed in this view that during operation the firing chamber contains a desired electrospray sample material and that liquid material, vapor material, and air interfaces are present. As shown in FIG. 3B, the base of the silicon substrate (350), a p-type silicon volume (331), is covered with a thermal field oxide and chemical vapor deposited $SiO_2$ as the under layer (332). A layer (333) of tantalum aluminum (TaAl) is deposited by conventional methods on the surface of the base and, because it is of a relatively high electrical resistance, forms a resistor layer. A conductor layer (334) of aluminum (Al) is then selectively deposited on the TaAl layer (333) by means of photolithographic masking and developing, leaving open areas of TaAl. The high resistance of the TaAl layer (333) is effectively shorted by the Al layer (334) except in the open areas because of the relatively low electrical resistance of the Al layer (334). The result is a resistor area capable of transferring heat produced from electrical resistance heating of the TaAl layer (333) in this open area for the purpose of vaporizing sample material.

The areas below the resistor area are capable of withstanding thermal extremes, mechanical assault, and chemical attack which result from the rapid vaporization of sample material and subsequent collapse of a sample material bubble. Accordingly, a passivating layer (335), such as a typical $SiN_x$ compound, may be deposited over the structure. Further, a cavitation barrier (336) of tantalum (Ta) may be deposited over and selectively etched from the passivation layer (335) in the material firing chamber to protect against impact created by a collapsing bubble. The cavitation barrier (336) along with the chamber walls (330, 370) and the orifice plate (320) define the material firing chamber (360; FIG. 3A).

As discussed above, the material dispenser (300) may be configured to function as an electrospray ion source by selectively dispensing a desired material. Accordingly, the thermal inkjet architecture, the drive waveform produced by the thermal inkjet, the pulse spacing of the thermal inkjet, and/or the material properties of the sample material may be adjusted to produce varying material droplets as desired by a user. According to one exemplary embodiment, the thermal inkjet material dispenser (300) illustrated in FIG. 3A may be fired at frequencies varying from, but in no way limited to, 1 kHz to 200 kHz to produce material drop volumes ranging from 5 picoliters (pL) to 140 pL (assuming the sample material density is approximately 1 gram per milliliter). The above exemplary embodiment describes a range of frequencies and drop volumes for illustrative purposes only and the results may be altered by varying a number of factors including, but in no way limited to, sample density and thermal inkjet material dispenser properties.

Returning again to FIG. 2, a computing device may optionally be communicatively coupled to the thermal inkjet material dispenser (220) to control the discharge of sample material drops. According to one exemplary embodiment, the computing device (270) may control the frequency which the thermal inkjet material dispenser (220) discharges the sample material drops, thereby controlling a factor of the drop size. The computing device (270) illustrated in FIG. 2 may be, but is in no way limited to, a personal computer, a laptop computer, a personal digital assistant (PDA), a palm computer, a tablet computer, or any other processor containing device.

An electrically conductive grid (230) is disposed immediately adjacent to the thermal inkjet material dispenser (220) according to one exemplary embodiment. As illustrated in FIG. 2, the electrically conductive grid (230) is an arrangement of wires or other conductive materials to which an electric potential may be applied. The electrically conductive grid (230) is disposed to allow any sample source generated by the thermal inkjet material dispenser (220) to pass there through. According to one exemplary embodiment, the distance separating the thermal inkjet material dispenser (220) and the electrically conductive grid (230) is in the order of a few centimeters (cm). More specifically, according to one exemplary embodiment, the electrically conductive grid (230) is disposed from approximately 0.5 cm to approximately 3 cm from the thermal inkjet material dispenser (220).

During operation of the thermal inkjet electrospray ion source (200), a voltage is variably applied to the electrically conductive grid (230). Consequently, the electrically conductive grid (230) may be formed of any conductive material to produce the desired result. However, according to one exemplary embodiment, the electrically conductive grid (230) is formed of (316) stainless steel.

Figure 4:
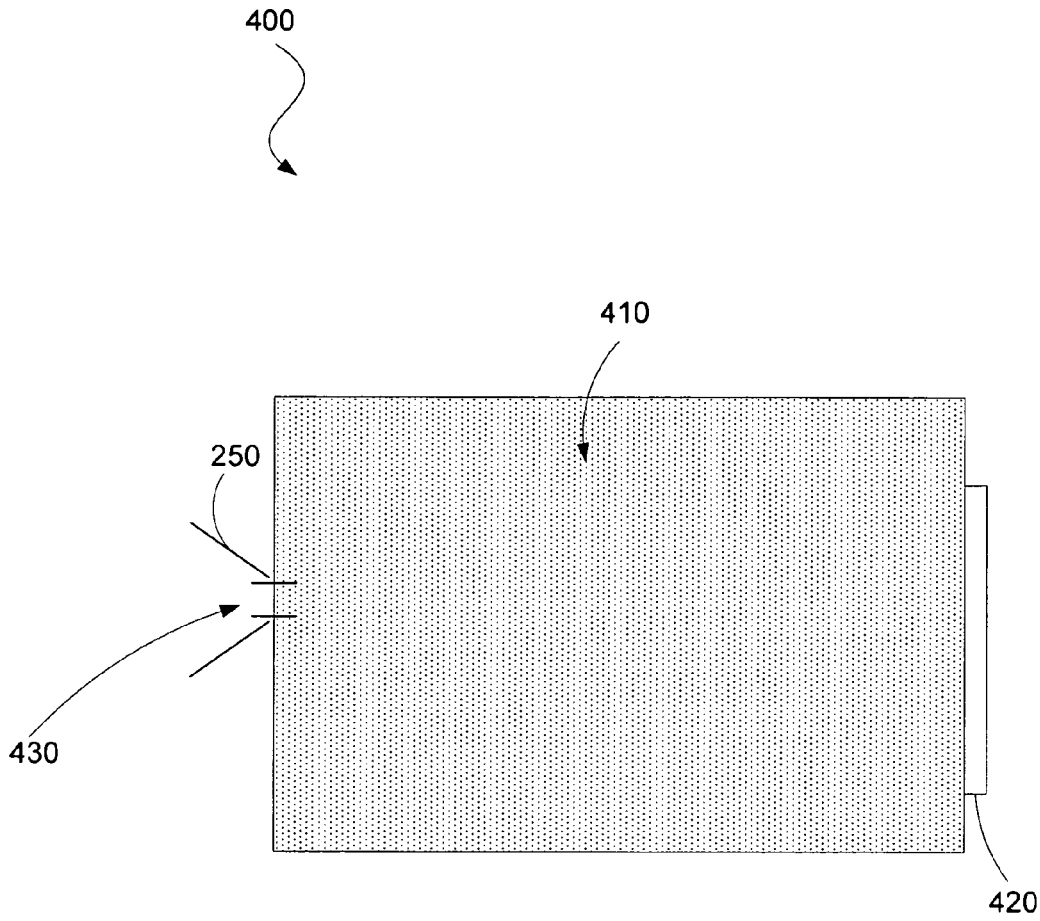
FIG. 4 is a simple block diagram illustrating the internal components of a time-of-flight mass spectrometer according to one exemplary embodiment.

Opposite the electrically conductive grid (230) is a counter electrode (240). Similar to the electrically conductive grid (230), the counter electrode (240) receives a variable voltage, depending on the properties of the sample material used, to create a potential between the electrically conductive grid (230) and the counter electrode (240). According to one exemplary embodiment, the potential created between the electrically conducive grid (230) and the counter electrode ranges from approximately three to five kilovolts. Consequently, the counter electrode (240) may be made of any conductive material. However, according to one exemplary embodiment, the counter electrode comprises (316) stainless steel. As shown in FIG. 2, the counter electrode (240) leads to the Einzel/ion lenses (250). The Einzel/ion lenses (250) are electrostatic lenses which help focus ions in and out of a trap along the axis of the mass spectrometer (260). While the Einzel/ion lenses (250) described above are one example of ion lenses that may be used to focus ions into the mass spectrometer (260), any ion lens configured to focus ion analytes may be incorporated into the present thermal inkjet ion source (200). FIG. 4 further illustrates a number of components of a time-of-flight mass spectrometer (400) according to one exemplary embodiment. As illustrated in FIG. 4, an exemplary time-of-flight mass spectrometer (400) includes an orifice (430) leading to a field-free drift region (410) and an ion detector (420). The field-free drift region (410) is an area within the time-of-flight mass spectrometer (400) where no external fields act upon received ions and they are allowed to freely drift to the ion detector (420). According to one exemplary embodiment, pulsed electrospray ions enter the mass spectrometer (400) through the orifice (430) where they are separated according to their mass-to-charge ratio in the field-free drift region (410). The ions continue on in the mass spectrometer (400). The ions with smaller mass-to-charge ratio ratios reach the ion detector (420) first. Once the ion detector (420) is reached, the ions are detected and analyzed according to mass.

According to one exemplary embodiment, the time-of-flight mass spectrometer (400) receives ions that are accelerated by a potential difference between the grid (230; FIG. 2) and the counter electrode (240; FIG. 2) of the thermal inkjet electrospray ion source (200; FIG. 2). Consequently, the ions enter the time-of-flight mass spectrometer (400) with an initial kinetic energy ($E_i$) of $E_{i=}\frac{1}{2}mv^2$ Rearranging the kinetic energy equation, as illustrated in Equation 1 in light of the standard velocity identity v=d/t:

$$t_{of\ flight} = d\sqrt{\frac{m}{2E_i}} \quad \text{Eq. 1}$$

one can see that the kinetic energy applied to the ions ($E_i$) and drift distance of the time-of-flight mass spectrometer (d) must remain constant to utilize the time of flight to determine the mass of the ions. As a result, the present TIJ electrospray ion source (200; FIG. 2) applies a pulse of energy to the ions.

According to this exemplary embodiment, the time-of-flight mass spectrometer (400) is calibrated in a mass range of interest by determining the time-of-flight of two ions of known mass at extremes of a possible range. During this calibration process, the linear equation shown in equation 2:

$$t_{of\ flight} = \frac{d}{\sqrt{2E_i}} m^{\frac{1}{2}} + 0 \quad \text{Eq. 2}$$

can be used to determine the slope of the plot $t_{of\ flight}$ vs. $m^{1/2}$ for calibration of the time-of-flight mass spectrometer (400).

Exemplary Implementation and Operation

Figure 5:
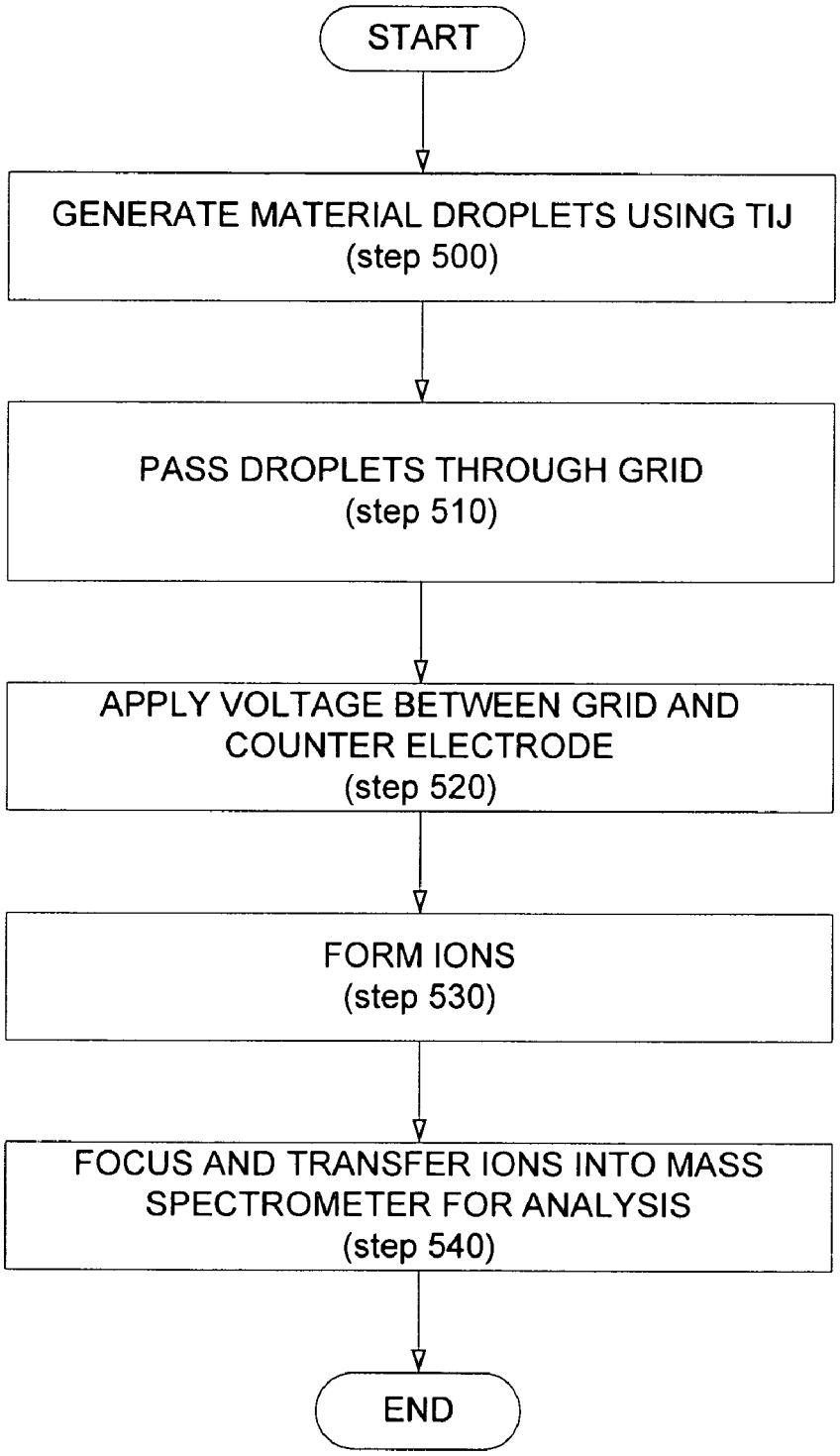
FIG. 5 is a flow chart illustrating a method for using a thermal inkjet material dispenser as an electrospray ion source according to one exemplary embodiment.

FIG. 5 is a flow chart illustrating a method for incorporating a thermal inkjet material dispenser in an electrospray ion source according to one exemplary embodiment. As illustrated in FIG. 5, the present method begins by generating small droplets of the sample material using a thermal inkjet material dispenser (step 500). Once the small droplets of sample material have been generated by the thermal inkjet material dispenser, they are allowed to pass through the electrically conducing grid (step 510). After the droplets of sample material have passed through the grid, a voltage difference is pulsed between the grid and the counter electrode (step 520). Consequently, charged ions of the sample are produced (step 530). Once produced, the charged ions are focused and transferred into a mass spectrometer for analysis (step 540). Each of the above-mentioned steps will now be explained in detail with reference to FIGS. 6A through 6C.

Figure 6A:
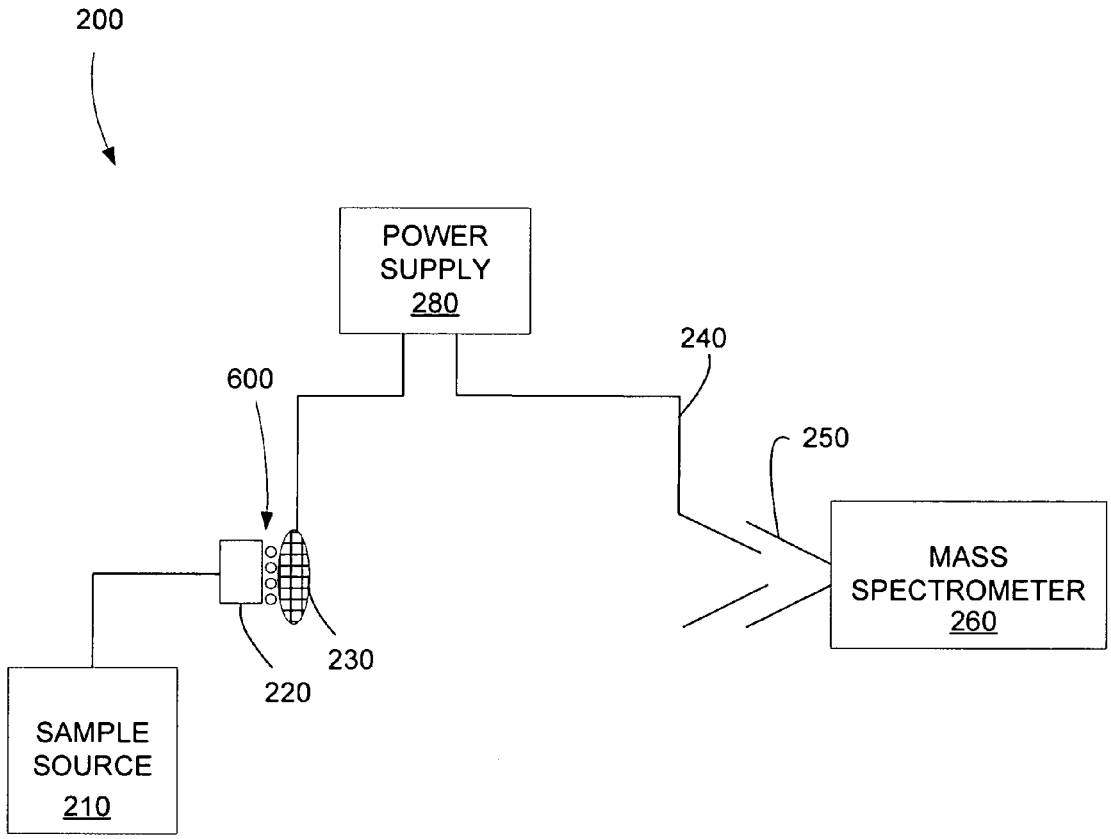
FIG. 6A is a system diagram illustrating the operation of an electrospray configuration including a thermal inkjet material dispenser according to one exemplary embodiment.

As shown in the flow chart of FIG. 5, the present method begins when the thermal inkjet material dispenser generates small droplets of the sample material (step 500). FIG. 6A illustrates the production of small droplets of the sample material (600). According to one exemplary embodiment, the small droplets of the sample material (600) are generated as a pulsed pack of sample material. As mentioned above with reference to FIGS. 3A and 3B, the thermal inkjet material dispenser generates small droplets of the sample material by heating a portion of the sample material present in a material firing chamber. Upon the application of thermal energy, a portion of the sample material is vaporized causing it to expand. The rapid expansion of the vaporized sample material forces a quantity of un-vaporized sample material out an orifice (310; FIG. 3) of the thermal inkjet material dispenser (220). As illustrated in FIG. 6A, a plurality of small droplets of sample material may be produced by a thermal inkjet material dispenser (220) containing a plurality of orifices (310; FIG. 3). Additionally, as illustrated above, the thermal inkjet material dispenser (220) is configured to produce a pulsed flow of sample material according to a variety of frequencies. Moreover, the plurality of small droplets of the sample material (600) may be produced in varying sizes well below the traditional drop size. Consequently, the small droplets of sample material (600) experience better dissolvation eventually leading to a reduction in adduct ion formation. In addition, because the present method eliminates the use of gasses in the ion source, ion fragmentation is reduced in comparison to traditional methods.

Once the plurality of small droplets of the sample material is produced (600), they are allowed to pass through the electrically conducting grid (step 510; FIG. 5). According to one exemplary embodiment, the electrically conducting grid (230) is held at a ground potential during the production of the small droplets of the sample material (600). By holding the electrically conducting grid (230) at ground potential, the small droplets of sample material (600) are allowed to pass through the grid without interruption.

Figure 6B:
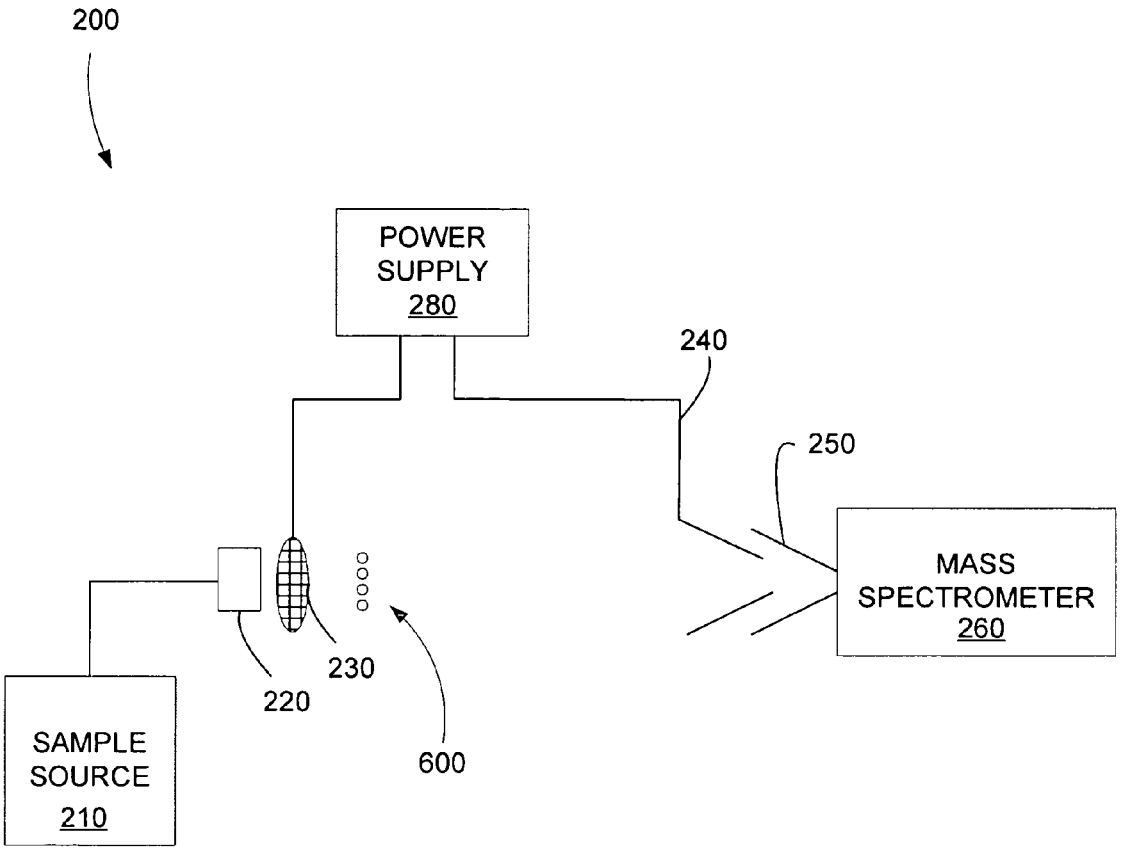
FIG. 6B is a system diagram illustrating the operation of an electrospray configuration including a thermal inkjet material dispenser according to one exemplary embodiment.

However, once the small droplets of sample material (600) have passed through the electrically conducting grid (230), as illustrated in FIG. 6B, the resistors of the thermal inkjet material dispenser (220) are set to ground potential thereby stopping the production of additional small droplets of sample material (600) thereby forming a pulsed pack of sample material. Additionally, once the small droplets of sample material (600) have passed through the electrically conducting grid (230), a pulsed voltage difference is applied between the grid and the counter electrode (240). According to one exemplary embodiment, the voltage difference applied between the electrically conducting grid (230) and the counter electrode (240) by the power supply (280) is approximately 1 to 5 kilovolts. However, a number of combinations of voltages may be used depending on the design of the thermal inkjet material dispenser (220) used and/or the properties of the sample material.

Figure 6C:
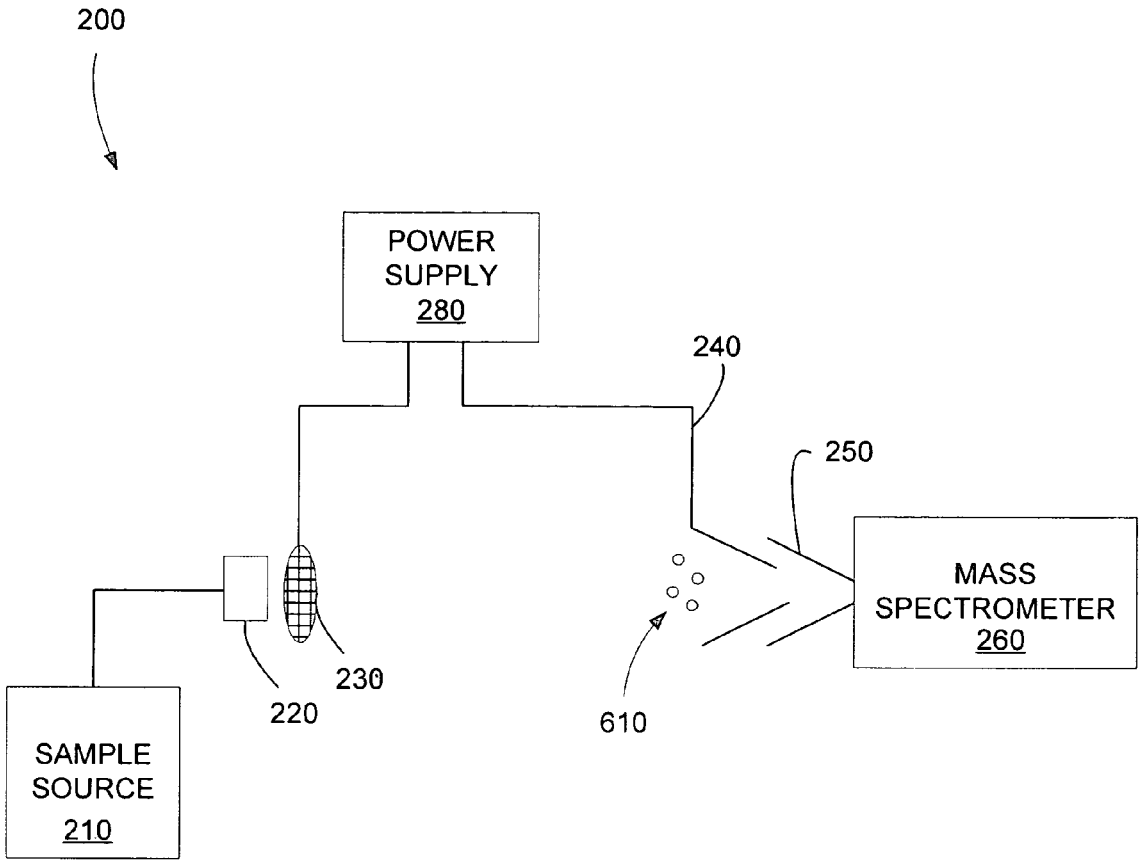
FIG. 6C is a system diagram illustrating the operation of an electrospray configuration including a thermal inkjet material dispenser according to one exemplary embodiment.

As mentioned above, the small droplets of sample material (600) react to the above-mentioned voltage difference, causing them to be accelerated towards the Einzel/ion lenses (250) and the mass spectrometer (260). During this acceleration, an electrospray process occurs and the charged ions of the sample material are formed (step 530; FIG. 5). In further detail, the electrospray process begins with an accumulation of positively charged ions in the small droplets of sample material (600) causing surface instability. When the coulombic repulsion, i.e., the repulsion among similarly-charged particles, that occurs between the positively charged ions of the sample material (600) exceeds the surface tension of the sample material (600), smaller droplets will start to come off the surface of the liquid, forming a mist. As these droplets travel towards the counter electrode (240), a solvent portion of the sample material evaporates causing the droplets to shrink and, as a consequence, the distance between positive charges at the surface of the droplets become smaller and charge repulsion gets stronger. This process continues until the Coulombic repulsions are stronger than the surface tension of the droplet (a condition called the Rayleigh instability limit) causing the droplet to explode into smaller charged droplets of analyte molecules (610) ready to be analyzed in the mass spectrometer (260) as illustrated in FIG. 6C. The above-mentioned electrospray process is more efficacious with smaller droplets of sample material. Consequently, the present system and method increase the efficiency of ionization.

Once the ions are formed through the electrospray process (step 530; FIG. 5), the sample ions (610) are focused by the Einzel/ion lenses (250) into the mass spectrometer (260) for mass analysis (step 540; FIG. 5). As noted above, the Einzel/ion lenses (250) focus the sample ions (610) through the application of an electrostatic force. Once focused, the ions are passed into the mass spectrometer (260) where they are analyzed as explained above.

While the above-mentioned system and method has been explained in the context of a thermal inkjet dispenser incorporated into a time-of-flight mass spectrometer system, the present system and method may be incorporated into any number of electrospray ionization systems.

In conclusion, the present system and method effectively allow for the production of very small droplets of a sample material using a thermal inkjet material dispenser. More specifically, the present system and method use a thermal inkjet material dispenser in conjunction with an electrically conductive grid to produce ions for a mass spectrometer. By reducing the droplet size, better dissolvation results leading to less adduct ion formation and greater signal due to an increased efficiency in ionization. Additionally, the present system and method eliminates the need for a gas source in the generation of the electrospray resulting in reduced ion fragmentation.

Moreover, the present system and method provides a more efficient production of electrospray ion packs for a time-of-flight mass spectrometers. The present system and method allow the time-of-flight mass spectrometer to be located in line with respect to the electrospray ion source. Consequently, the ion transmission to the mass spectrometer is increased, detection limits are decreased, and higher sensitivity is exhibited by the time-of-flight mass spectrometer.

The preceding description has been presented only to illustrate and describe exemplary embodiments of the present system and method. It is not intended to be exhaustive or to limit the present system and method to any precise form disclosed. Many modifications and variations are possible in light of the above teaching. It is intended that the scope of the present system and method be defined by the following claims.

What is claimed is:

1. A system for producing electrospray ions comprising:

a thermal inkjet material dispenser configured to selectively emit a plurality of sample material particles; and an electrically conducting grid disposed in proximity with said thermal inkjet material dispenser;

said grid being configured to permit a selective passage of said plurality of sample material particles.

2. The system of claim 1, wherein said electrically conducting grid is disposed between approximately 0.5 cm and 3.0 cm from said thermal inkjet material dispenser.

3. The system of claim 1, further comprising a sample material reservoir fluidly coupled to said thermal inkjet material dispenser.

4. The system of claim 3, wherein said reservoir is configured to house a jettable sample material.

5. The system of claim 1, further comprising a counter electrode disposed adjacent to said electrically conducting grid.

6. The system of claim 5, wherein said grid and said counter electrode are configured to produce a potential sufficient to generate electrospray ions from said plurality of sample material particles.

7. The system of claim 6, wherein said potential comprises between approximately 3 to 5 kilovolts.

8. The system of claim 1, wherein said thermal inkjet material dispenser further comprises:

a material firing chamber;

a heating component disposed within said material firing chamber; and an orifice extending into said material firing chamber.

9. The system of claim 8, further comprising a second, orifice extending into said material firing chamber.

10. The system of claim 8, wherein said electrically conducting grid is disposed adjacent to said orifice.

11. The system of claim 1, wherein said electrically conducting grid comprises a metal.

12. The system of claim 11, wherein said electrically conducting grid comprises stainless steel.

13. The system of claim 1, further comprising:

an ion lens disposed in proximity with said electrically conducting grid; and a mass spectrometer associated with said ion lens;

wherein said ion lens is configured to direct an ionic sample material particle into said mass spectrometer.

14. The system of claim 13, wherein said ion lens comprises an Einzel/ion lens.

15. The system of claim 13, wherein said mass spectrometer comprises a time-of-flight mass spectrometer.

16. The system of claim 1, wherein said thermal inkjet material dispenser is configured to produce said plurality of sample material particles at a frequency between approximately 1 kHz and 200 kHz.

17. The system of claim 16, wherein said thermal inkjet material dispenser is configured to produce a plurality of sample material particle volumes when operating at said frequency;

wherein said sample material particle volumes range from approximately 5 picoliters (pL) to approximately 140 pL.

18. The system of claim 16, wherein said thermal inkjet material dispenser is configured to produce said sample material particles as a pulsed flow.

19. The system of claim 1, further comprising:

a computing device communicatively coupled to said thermal inkjet material dispenser;

said computing device being configured to control an emission of said sample material particles from said thermal inkjet material dispenser.

20. The system of claim 19, wherein said computing device comprises one of a personal computer, a laptop computer, a personal digital assistant (PDA), a palm computer, a tablet computer, or a processor.

21. A method for using a thermal inkjet material dispenser as an electrospray ion source comprising:

emitting a plurality of small droplets of a sample material from said thermal inkjet material dispenser;

passing said droplets of sample material through an electrically conductive grid disposed adjacent to said thermal inkjet material dispenser;

generating a voltage potential between said grid and a counter electrode; and performing an electrospray process on said droplets as they are attracted from said grid to said counter electrode.

22. The method of claim 21, further comprising maintaining said grid at a ground potential during the emission of said plurality of small droplets from said thermal inkjet material dispenser.

23. The method of claim 21, wherein said emitting a plurality of small droplets of a sample material comprises:

filling a material firing chamber with a desired jettable material;

heating a heating component of said thermal inkjet material dispenser sufficient to vaporize a portion of said desired jettable material;

wherein said vaporization forces an unvaporized quantity of said desired jettable material out of said thermal inkjet material dispenser toward said electrically conductive grid.

24. The method of claim 23, wherein said step of generating a plurality of small droplets further comprises generating a pack of small droplets.

25. The method of claim 21, wherein said voltage potential generated between said grid and said counter electrode comprises between approximately 3 kilovolts to approximately 5 kilovolts.

26. The method of claim 21, wherein said electrospray process is configured to produce a plurality of ions.

27. The method of claim 26, further comprising focusing said generated ions towards a mass spectrometer.

28. The method of claim 27, wherein said focusing said generated ions further comprises focusing said generated ions with an Einzel/ion lens associated with said mass spectrometer.

29. The method of claim 27, wherein said mass spectrometer comprises a time-of-flight mass spectrometer.

30. A thermal inkjet material dispenser configured to function as an electrospray ion source comprising:

a thermal inkjet material dispenser body configured to selectively emit a plurality of sample material particles;

an electrically conducting grid disposed adjacent to said thermal inkjet material dispenser body; and said grid being configured to selectively permit a passage of said plurality of sample material particles.

31. The thermal inkjet material dispenser of claim 30, wherein said thermal inkjet material dispenser body further comprises:

a material firing chamber;

a heating component disposed within said material firing chamber; and an orifice extending into said material firing chamber.

32. The thermal inkjet material dispenser of claim 31, further comprising a second orifice extending into said material firing chamber.

33. The thermal inkjet material dispenser of claim 31, wherein said electrically conducting grid is disposed between approximately 0.5 cm and 3.0 cm from said orifice.

34. The thermal inkjet material dispenser of claim 31, further comprising a sample material reservoir fluidly coupled to said thermal inkjet material dispenser body.

35. The thermal inkjet material dispenser of claim 34, wherein said sample material reservoir is configured to house a jettable sample material.

36. The thermal inkjet material dispenser of claim 30, wherein said electrically conducting grid comprises a metal.

37. The thermal inkjet material dispenser of claim 36, wherein said electrically conducting grid comprises stainless steel.

38. The thermal inkjet material dispenser of claim 30, wherein said thermal inkjet material dispenser body is configured to produce said plurality of sample material particles at a frequency between approximately 1 kHz and 200 kHz.

39. The thermal inkjet material dispenser of claim 38, wherein said thermal inkjet material dispenser body is configured to produce a plurality of sample material particle volumes;

said plurality of sample material particle volumes ranging from approximately 5 picoliters (pL) to 140 pL when operating at said frequency.

40. The thermal inkjet material dispenser of claim 38, wherein said thermal inkjet material dispenser is configured to produce said sample material particles as a pulsed flow.

41. A system for producing electrospray ions comprising:

a means for thermally actuating the discharge of a plurality of sample material particles;

a means for emitting said sample material particles disposed adjacent to said means for thermally actuating a discharge, said means for emitting being configured to selectively apply a voltage potential; and said means for emitting being configured to permit a passage of said plurality of sample material particles.

42. The system of claim 41, wherein said means for emitting said sample material particles is disposed between approximately 0.5 cm and 3.0 cm from said means for thermally actuating a discharge.

43. The system of claim 41, further comprising:

a means for storing sample material;

said means for storing being fluidly coupled to said means for thermally actuating a discharge.

44. The system of claim 41, further comprising a counter electrode disposed adjacent to said means for emitting said sample material particles.

45. The system of claim 44, wherein said means for emitting said sample material particles and said counter electrode are configured to produce a potential sufficient to generate electrospray ions from said sample material particles.

46. The system of claim 45, wherein said potential comprises between approximately 3 to 5 kilovolts.

47. The system of claim 41, wherein said means for emitting said sample material particles comprises a metal grid.

48. The system of claim 47, wherein said metal grid comprises stainless steel.

49. The system of claim 41, further comprising:

a means for channeling an ion; and a mass spectrometer associated with said means for channeling an ion;

wherein said means for channeling an ion is configured to direct an ionic sample material particle into said mass spectrometer.

50. The system of claim 49, wherein said mass spectrometer comprises a time-of-flight mass spectrometer.

51. The system of claim 41, wherein said means for thermally actuating a discharge is configured to produce said plurality of sample material particles at a frequency between approximately 1 kHz and 200 kHz.

52. The system of claim 51, wherein said means for thermally actuating a discharge is configured to produce a plurality of sample material particle volumes ranging from 5 picoliters (pL) to 140 pL when operating at said frequency.

53. The system of claim 41, wherein said means for thermally actuating a discharge is configured to produce said sample material particles as a pulsed flow.

54. A method for inputting a sample material to a mass spectrometer using a thermal inkjet material dispenser as an electrospray ion source, said method comprising:

emitting a plurality of droplets of said sample material from said thermal inkjet material dispenser for use by said spectrometer.

55. The method of claim 54, wherein emitting a plurality of droplets further comprises:

passing said droplets of sample material through an electrically conductive grid disposed adjacent to said thermal inkjet material dispenser;

generating a voltage potential between said grid and a counter electrode; and performing an electrospray process on said droplets as they are attracted from said grid to said counter electrode.

56. The method of claim 55, further comprising maintaining said grid at a ground potential during the emission of said plurality of small droplets from said thermal inkjet material dispenser.

57. The method of claim 55, wherein said emitting a plurality of droplets of a sample material comprises:

filling a material firing chamber with a desired jettable material;

heating a heating component of said thermal inkjet material dispenser sufficient to vaporize a portion of said desired jettable material;

wherein said vaporization forces an unvaporized quantity of said desired jettable material out of said thermal inkjet material dispenser toward said electrically conductive grid.

58. The method of claim 55, wherein said voltage potential generated between said grid and said counter electrode comprises between approximately 3 kilovolts to approximately 5 kilovolts.

59. The method of claim 55, wherein said electrospray process is configured to produce a plurality of ions.

60. The method of claim 59, further comprising focusing said generated ions towards said mass spectrometer.

61. The method of claim 60, wherein said focusing said generated ions further comprises focusing said generated ions with an Einzel/ion lens associated with said mass spectrometer.

62. The method of claim 54, wherein said mass spectrometer comprises a time-of-flight mass spectrometer.

63. A mass spectrometer system having a thermal inkjet material dispenser configured to function as an electrospray ion source comprising:

a thermal inkjet material dispenser configured to selectively emit a sample material;

a mass spectrometer configured to receive said sample material for analysis.

64. The system of claim 63, further comprising a system for directing said sample material from said thermal inkjet material dispenser to said mass spectrometer comprising an electrically conducting grid disposed adjacent to said thermal inkjet material dispenser body, said grid being configured to selectively permit a passage of said sample material.

65. The system of claim 63, wherein said thermal inkjet material dispenser body further comprises:

a material firing chamber; and a heating component disposed within said material firing chamber.

66. The system of claim 63, further comprising a sample material reservoir fluidly coupled to said thermal inkjet material dispenser.

67. The system of claim 63, wherein said thermal inkjet material dispenser is configured to selectively emit droplets of said sample material at a frequency between approximately 1 kHz and 200 kHz.

68. The system of claim 63, wherein said thermal inkjet material dispenser is configured to selectively emit a range of volumes of said sample material.

69. The system of claim 68, wherein said range is from approximately 5 picoliters (pL) to 140 pL.

70. The system of claim 63, wherein said thermal inkjet material dispenser is configured to emit said sample material as a pulsed flow.

* * * * *